United States Patent [19]

Graham

[11] 4,038,781

[45] Aug. 2, 1977

[54] JAMB SEAL

[75] Inventor: Richard W. Graham, Williamstown, W. Va.

[73] Assignee: The Airolite Company, Marietta, Ohio

[21] Appl. No.: 668,505

[22] Filed: Mar. 19, 1976

[51] Int. Cl.[2] ..... E06B 7/086

[52] U.S. Cl. ..... 49/91; 49/90; 98/121 A

[58] Field of Search ..... 49/91, 92, 90, 74, 75, 49/89; 98/121 R, 121 A, 110; 160/1

[56] References Cited

U.S. PATENT DOCUMENTS

| | | | |
|---|---|---|---|
| 3,180,246 | 4/1965 | Johnson | 49/90 X |
| 3,372,514 | 3/1968 | Adams | 49/91 |
| 3,575,229 | 4/1971 | Allex | 160/1 |
| 3,631,790 | 1/1972 | Olsen et al. | 98/110 |
| 3,715,971 | 2/1973 | Moyer | 98/110 |

*Primary Examiner*—Philip C. Kannan
*Attorney, Agent, or Firm*—Burd, Braddock & Bartz

[57] ABSTRACT

A louver assembly has a plurality of louver blades and pivot shafts pivotally supported for adjustable movement between open and closed position in a frame which includes two opposed vertical side frame members. A jamb seal between each side frame member and the adjacent ends of the louver blades prevents air flow around the ends of the blades when the blades are closed. Each jamb seal includes a panel installed between a side frame member and the transverse louver blade ends facing that side frame member. Each panel includes a rigid but flexible, substantially flat, face portion adapted for flush contact with the blade ends when the blades are closed, and two outer and two inner elongated rigid supporting ribs integral with respect to the face portion and extending away from that side of the face portion opposite the blades. The edges of these ribs away from the face portion are provided from top to bottom with elastic sealing cushions. Each outer rib has a thin resilient air seal flipper being in sealing relation to its side frame member. The louver blades tend to force each panel towards its associated side frame member, placing the panels and the cushions under compression. This completely seals the space between the blade ends and their associated side frame members when the blades are closed. Transverse slots are provided halfway through the panels to receive the louver pivot shafts as the panels are installed by sliding them between the blade ends and the side frame members.

13 Claims, 4 Drawing Figures

FIG. 1
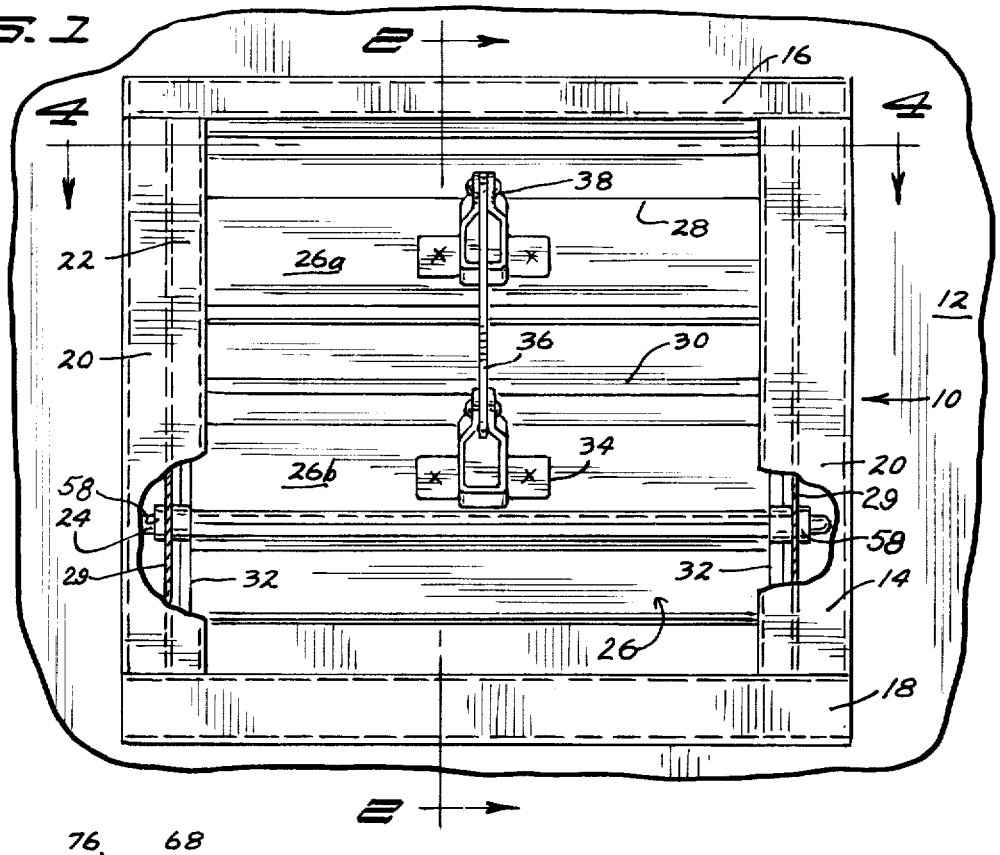
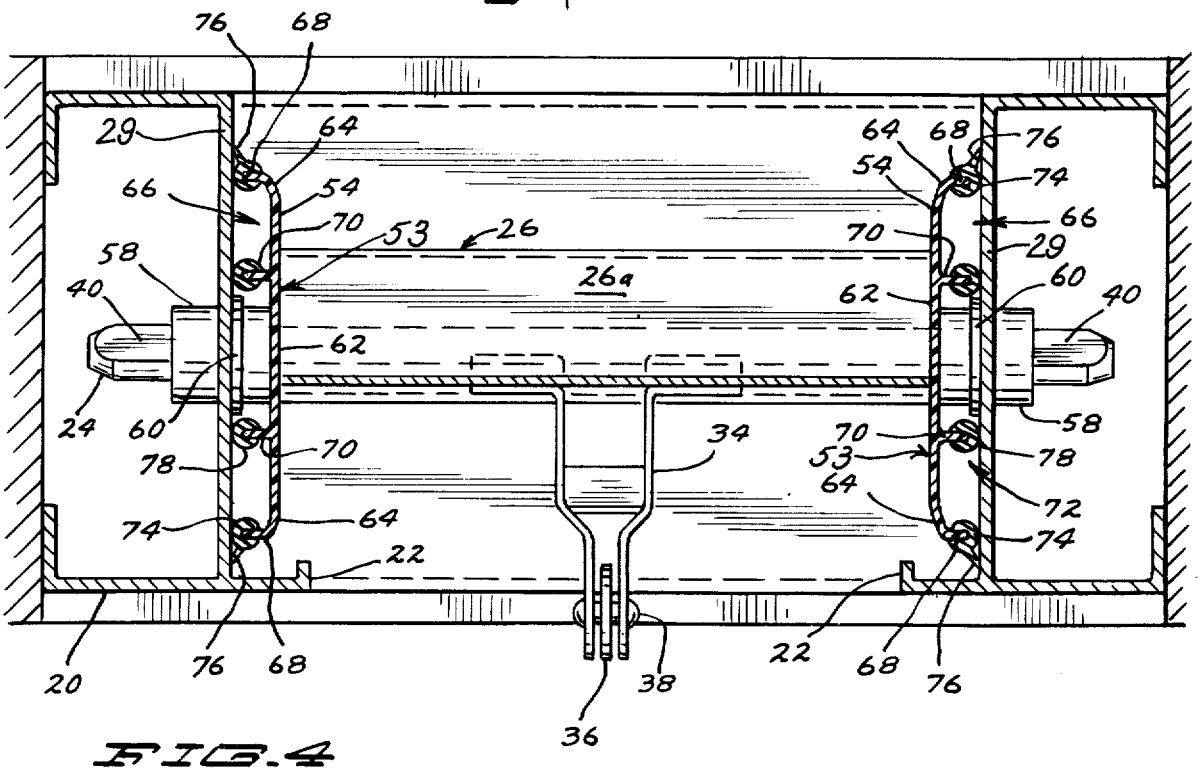
FIG. 4

JAMB SEAL

BACKGROUND OF THE INVENTION:

Glass window jalousies and metal wall louvers usually include a rectangular frame and a plurality of elongated louver blades extending horizontally from one vertical side member of the frame to the other. Means are provided for pivotally mounting the blades between the side frame members and for rotating them in unison between closed and open positions.

A persistent problem with such louver assemblies has been leakage of air, rain, snow and the like between the side frame members and their adjacent louver blade ends. In colder climates, storm windows are often installed to stop such air flow, but this eliminates opportunity ot ventilate through the louvers while the storm windows are in place. In warmer climates, complete blockage of air flow could not be achieved at any time. This occasions severe and unacceptable heat and energy losses during cold weather; and similar energy losses in hot weather when air conditioning is being used.

The prior art reveals several attempted solutions. U.S. Pat. No. 2,390,394 granted to Smith on Dec. 4, 1945, for example, describes a louver arrangement including a plurality of glass plates horizontally arranged between two side frame members. A disc is attached to each end of the glass plates, each disc being rotatably mounted with respect to one of the opposing side frame members. Felt strips secured to each side frame member between each disc and the side frame member provide a means for sealing the window against air passage. This structure is cumbersome and expensive and can develop high friction against louver movement.

In U.S. Pat. No. 2,394,059 to Hite, granted Feb. 5, 1946, glass louver blades are supported horizontally between two opposing vertical guides of a frame. Each louver blade is supported at its transverse ends by an end holder, each end holder being pivotally mounted with respect to one of the vertical guides. A packing strip is mounted in each end holder and projects laterally beyond the end holder edge to engage with the adjacent vertical guide to form a joint. The packing strip is felt, rubber, asbestos or the like. The structure suffers from the lack of resilient means to positively engage the sealing member between the blade end and the vertical guide without unduly increasing the friction to blade movement. The seal will be at its best (and friction highest) when first installed. As the packing strip ages and weather, the seal progressively deteriorates over the entire life of the shutter structure.

In U.S. Pat. No. 3,894,481, granted to Alley on July 5, 1975, a multi-blade damper is shown having a plurality of rectangular blades mounted in a rectangular frame on transversely extending parallel shafts. The ends of each movable blade carry a sealing flap rigidly attached and extending longitudinally beyond the blade edges into sliding surface contact with the vertical side channels of the frame. The flaps are constructed of resilient material. No positive means of insuring good contact as the unit ages is provided. Also the area around the pivot shaft is not sealed.

In U.S. Pat. No. RE 23,182 to Cooper reissued Dec. 13, 1949 on original grant of Jan. 4, 1949, the louver blades are pivotally mounted at each end to a vertical metal fitting having a face portion abutting the blade edges and two outer edge flange portions abutting the vertical sides of the window frame. Holes in the metal fitting are adapted to receive channeled end members which support the louver blades. Each channeled end member has a protecting metal strip pivotally attached at one end to a bridging member. Vertical movement of the bridging member causes all louver blades to rotate in unison about their respective pivot points. When the louver assembly is in the closed position, the bridging member occupies the space between the metal fittings and the channeled end members, overlapping the protecting strip and the metal fitting. As seen in FIG. 3 of that patent, for example, no positive seal is achieved. The structure is awkward and expensive.

The general idea of inserting a flexible side sealing member between frame side members and the associated transverse louver blade ends is shown in U.S. Pat. No. 3,372,514 granted to Adams on Mar. 12, 1968. A side sealing member is positioned between the ends of the louver blades and each vertical side frame member. Each side sealing member has a generally U-shaped cross sectional configuration and includes a central web portion facing inward toward the blade ends. Two flanges are directed outward toward the vertical side member. The edges of the flanges are meant to engage with the surface of the side frame member while the central web portion is meant to engage with the ends of the louver blades. The side sealing members are formed from a flexible material such as Phosphor bronze. The purpose of the invention is to "minimize light leaks and to . . . minimize ingress of wind, rain, snow and debris." No Claim is made to positively seal against air passage and no positive means is provided to keep the U-shape sealing member flat enough to continue to provide a positive end seal as time and weather takes its toll. As long as the flanges hold up no center seal need be maintained to provide a light shield, and there will be no disadvantage to the structure when the face of the sealing member becomes concave as it will in time.

The Smith, Hite and Alley louver assemblies share the problem of requiring contact between a rigid surface and a soft or elastic material. Wear to the elastic or softer material is caused by rubbing contact with the rigid surface whenever the louver blades are moved. Eventually this damages the elastic material and leakage results. Cooper avoids this problem by including only substantially rigid materials in his louver assembly. A problem with Cooper, however, it the close manufacturing tolerance required to form the sliding but snug contact between the bridging member and the metal fitting.

In the Adams device, there is no support for the central web portion, as the side sealing member is supported against the side frame member solely by the two outside flanges. With the louver assembly closed, the pressure from the louver blades acts principally upon the center of the web. The resulting tendency, in the flexible side sealing member, to deform concavely with respect to the blade edges tends to hinder pivotal movement of the blades if a contact with the blade ends persists, and to allow air passage if not.

BRIEF SUMMARY OF THE INVENTION

This invention relates to a side sealing means or jamb seal particularly well suited for a conventional louver assembly including a frame spanned by a plurality of elongated louver blades, each blade mounted at each end to one of two opposed side frame members, and rotatable between open and closed positions. The side sealing means or jamb seal includes an elongated panel inserted between the surface of each side frame member and its associated transverse louver blade ends.

Each panel can be made of a rigid, flexible vinyl or other material displaying similar properties and includes a substantially flat face portion adapted for flush contact with one of the ends of each of said transverse blades. This face portion engages all of each such blade ends when the blades are in the closed position in sealing relation to each other. The face portion engages at least a portion of each such blade end when the louver blades are open. Fixed in relation to each face portion is a support means comprising two rigid outer ribs disposed vertically along the entire outer longitudinal edges of the face portion and two rigid inner ribs generally parallel to and coextensive with the length of the outer ribs. The ribs extend away from the face portion toward the surface of the side frame member. An elastic cushioning and sealing material extends outwardly from the outer edge portion of each rigid rib from one end of the panel to the other. Each outer rib has a thin resilient air seal flipper lying in sealing relation to its side frame member in position to prevent rain or air from being driven under cushioning material. A vinyl which has been processed in such a way as to be soft, or other material exhibiting similar characteristics has been found satisfactory for use as the cushioning material along the outer edge of the ribs and as the air seal flipper.

As the louver blade ends press against the panel face portion, the cushioning material is held in elastic compression against, and in sealing relation to, the surface of its associated side frame member regardless of any irregularities or variations in spacing of the inwardly facing surfaces of that side frame member.

Each jamb seal provides a total seal of the space between the louver blade ends and the side frame members. Transverse slots are provided halfway through each panel to receive the louver pivots shafts as the panel is installed after manufacture of the remainder of the louver assembly by sliding it between one of the side frame members and the adjacent blade ends. While substantially nominally flat when in place, the face portion of each panel is slightly convexly bowed in cross section before installation with the two outer ribs outer edges extending farther from the innermost surface of the face portion than the outer edges of the two inner ribs. The spacing and configuration of the face portion and ribs of each panel is such that the face portion cannot move past a flat plane configuration and into a concave deformation because of the bottoming on the side frame member by the inner ribs. Thus the jamb seals provide an effective louver blade end seal without hindering the pivotal blade movement.

The side sealing means or jamb seal is held in place by the flexibility of the rigid flexible panel attempting to regain its original bowed condition and by the pressure exerted by the elastic cushioning means. No extrinsic fastening means is needed. Such seals can be easily installed after manufacture of the balance of the louver assembly, and can be conveniently removed for cleaning, inspection and replacement. For use in areas and conditions where blade end sealing is not necessary, desirable or permitted, the jamb seals can be omitted or removed, making it unnecessary to stock separate louver assemblies both with and without jamb seals.

The elastic cushioning means, being in position as it is next to the side frame member, is protected from rubbing or sweeping contact with any moving part once it is installed. This results in longer effective life of the jamb seal. The original convex bowing of the panel and the presence of the cushioning means of each of the ribs makes for a perfect seal over a wide range of spacings between the blade ends and their associated side frame members, thereby eliminating the need for close manufacturing tolerances.

BRIEF DESCRIPTION OF THE DRAWINGS

FIG. 1 is a front elevational view of a structure wall section provided with a louver assembly incorporating the side sealing means or jamb seal of the invention, with parts in section and parts broken away;

FIG. 4 is an enlarged horizontal sectional view taken along line 4—4 in FIG. 1.

DESCRIPTION OF THE PREFERRED EMBODIMENT

Figure 2:
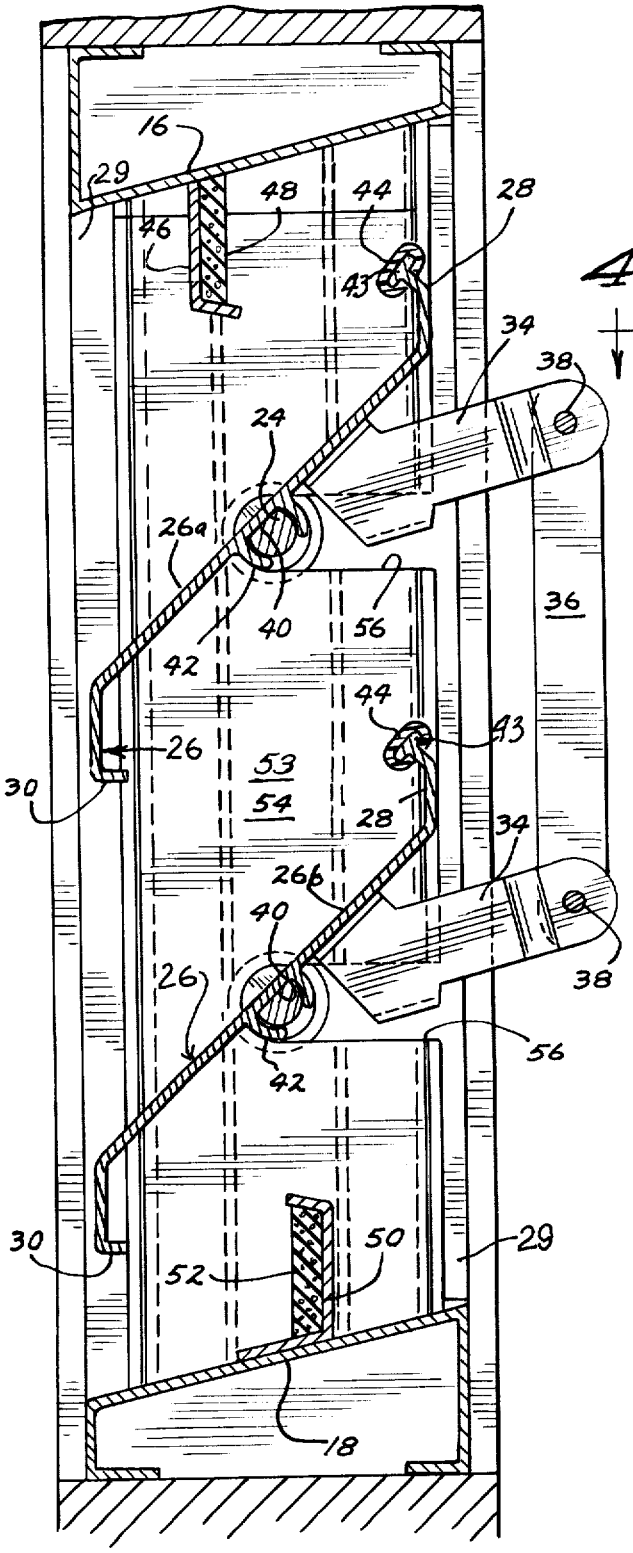
FIG. 2 is an enlarged vertical sectional view taken along line 2—2 in FIG. 1 with parts omitted for clarity, but showing blades of the louver assembly in an open position.

A louver assembly 10 is mounted by conventional means in a structure wall section 12. Louver assembly 10 has a frame 14 including a top end channel or frame member 16, a bottom end channel or frame member 18, and two side frame members or side channels 20, 20 fastened together by welding or other conventional means. Each side frame member 20 has a side frame member flange 22 extending inwardly of frame 14.

Louver blades 26 including an upper louver blade **26*a* and a lower louver blade 26*b* are mounted in frame 14 and extend from one side frame member 20 to the other. Each louver blade 26 is rigidly mounted on a louver blade pivot shaft 24. Each shaft 24 is rotatably mounted along its longitudinal axis with respect to the side frame members 20, 20 one end of each shaft 24 and an annular bearing or bushing 58 extending through an interior wall 29 of each side frame member 20, as seen from the cutaway portion of FIG. 1. Each louver blade 25 is therefore free to rotate or pivot about the longitudinal axis of its shaft 24 with respect to frame 14. Each bushing 58 is provided with a flange 60 which abuts wall 29**.

Each louver blade 26 includes an upper longitudinal blade edge 28, a lower longitudinal blade edge 30, and two transverse blade ends 32, 32.

A lug 34 is fixed at one end to each louver blade 26. The opposing end of each lug is pivotally mounted to an enlongated handle 36 by means of a pin 38. Movement of handle 36 generally along its longitudinal axis causes each lug 34 to rotate uniformly about the longitudinal axis of its respective louver blade pivot shaft 24, and therefore causes the louver blades **26*a* and 26*b*** to rotate uniformly about their respective axes.

Figure 3:
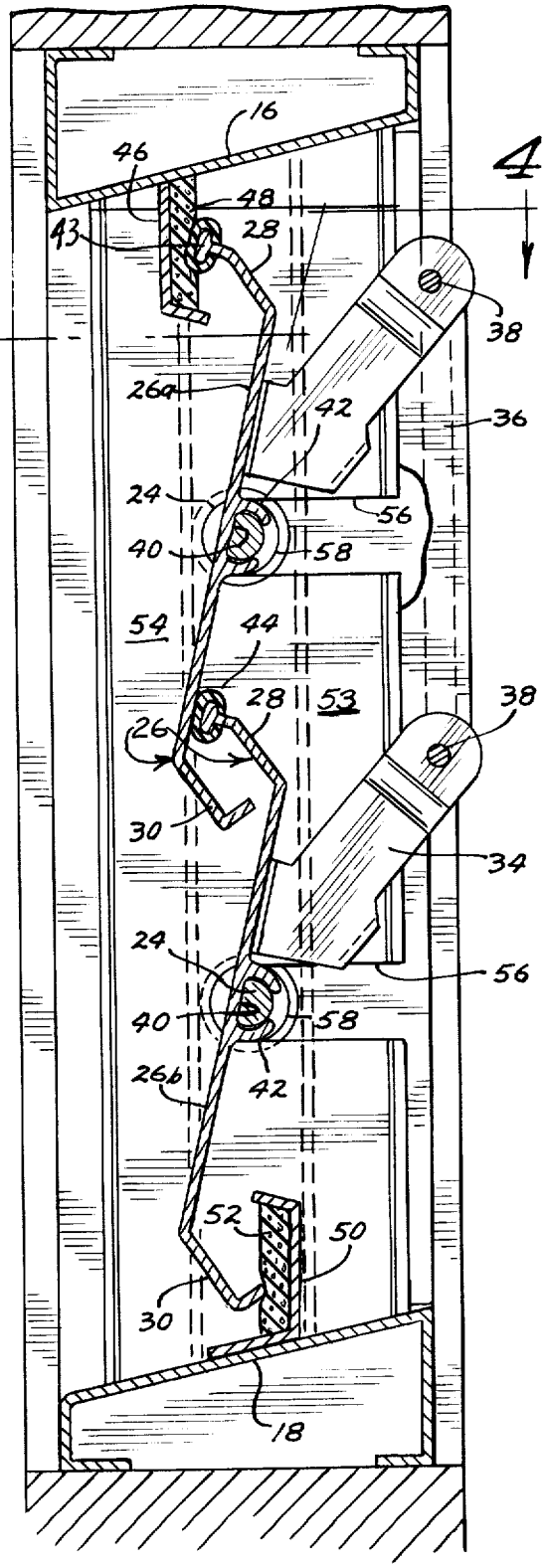
FIG. 3 is another enlarged vertical sectional view also taken along line 2—2 in FIG. 1 with parts omitted and showing the blades of the louver assembly in a closed position.

As seen in FIGS. 2 and 3, each shaft 24 has a flat portion 40 abutting the surface of its assoicated louver blade 26. Two fingers 42, 42 in each louver blade 26 are adapted to substantially enclose shaft 24 and to maintain flat portion 40 and the surface of louver blade 26 in face-to-face contact. The alignment of flat portion 40 with louver blade 26 prevents rotation of blade 26 with respect to shaft 24.

Louver blades **26*a* and 26*b* are adjustable between a closed position as shown in FIG. 3 and a variety of open positions, one of which is shown in FIG. 2. As seen in those figures, each upper longitudinal blade edge 28 includes a knob end 43, substantially enclosed by a gasket 44. An upper end detent 46 is fixed to the bottom surface of upper end frame member 16 and provided with padding 48. Likewise, a lower end detent 50 is mounted to the upper surface of lower end frame member 18 and is provided with padding 52. Upper end detent 46 and padding 48 are adapted to receive upper longitudinal blade edge 28 and gasket 44 of the upper louver blade 26*a* when that blade is in the closed position as seen in FIG. 3. Similarly, lower end detent 50 and padding 52 are adapted to receive lower longitudinal blade edge 30 of the lower louver blade 26*b* when that blade is in the closed position. Additionally, the closed position produces an intermediate coupling in which gasket 44 of lower louver blade 26*b* abuts the lower longitudinal blade edge 30 of the upper louver blade 26*a*. Gaskets 44, 44 together with padding 48 and 52** cooperate to provide a seal against light, wind and moisture along all longitudinal blade edges in a manner which is not unusual and forms no part of the invention.

In accordance with the invention, a jamb seal or side sealing means 53 including a jamb seal panel 54 is inserted between each interior wall 29 of each side frame member 20 and each coplanar set of louver blade ends 32 to positively provide a similar seal along these blade ends when the blades are closed. Preferably the panel 54 can be constructed of vinyl which can be processed to be rigid and flexible or other material exhibiting the qualitites of being rigid but being able to flex without breaking.

As seen in FIG. 3, each panel 54 is provided with slots or grooves 56 of sufficient width to accommodate an end of each shaft 24 and its bushing 58. This enables insertion of a jamb seal 53 between the blade ends and side frame member after the manufacture of the remainder of the louver assembly 10. Also, the jamb seal 53 is easily removed for periodic cleaning and inspection, if desired and for replacement when necessary or desirable.

As best seen in FIG. 4, each panel 54 includes a rigid but flexible face portion 62 which abuts one set of the transverse blade ends 32 of the louver blades 26, and two curved end portions 64, 64. A panel support means 66 comprises two rigid outer ribs 68, 68, and two rigid inner ribs 70, 70, all integral with and extending away from face portion 62. Ribs 68, 68 and 70, 70 extend along the entire length of panel 54.

Each jamb seal 53 also includes a cushioning means 72 including, as shown, two elongated, U-shape outer cushions 74, 74 and two elongated, U-shape inner cushions 78, 78. Each outer cushion 74 is fixed to and substantially surrounds the outer edge portion of each outer rib 68; and each inner cushion 78 is fixed to and substantially surrounds the outer edge portion of each inner rib 70. Each outer cushion 74 also includes an air seal flipper 76 extending radially outward therefrom and in position to press against the interior wall 29 of side frame member 20 to prevent the force of wind and/or capillary action from causing entry of moisture or air under the otherwise rounded edges of the cushion 74. Outer cushions 74, 74 and inner cushions 78, 78 are preferably constituted as an elastic material exhibiting the properties of a soft vinyl.

In the completed louver assembly, cushions 74 and 78 will be held in elastic compression between each panel support means 66 and the interior wall 29 of each side frame member 20. Consequently, there is created in each cushion 74 and 78 a spring-like force which continually tends to push face portions 62 of the panels 54 against their opposing transverse blade ends of each louver blade 26. When each panel 54 is not in place, its face portion 62 is slightly convexly bowed in cross section and flows smoothly into curved end portions 64, 64 which in turn are curved into outer ribs 68, 68. A transverse section through the face portion 62 lies in a single plane, however, when the panel is in such unstressed condition, the outer ribs 68, 68 extend farther away from a plane perpendicular to the ribs and passing through the innermost surface of the face portion 62 than do the inner ribs 70, 70. When each panel 54 is assembled in place, the face portion is forced to a substantially flat configuration, at least over that portion which contacts the louver blade ends 32 when the blades are closed. This insures a positive seal between the blade ends 32 and face portion 62.

The shape of the panels 54 and the size of the cushions 74 and 78 are such that when the face portion 62 reaches its flat shape from its slightly bowed convex shape, the inner ribs are supporting the face portion against wall 29 and the face portion cannot deform further.

It is seen from FIG. 4 that when louver blades 26 are in the closed position, all of each transverse blade edge is in flush contact with face portion 62 of one of panels 54, 54 providing a tight seal against rain, wind and the like. Likewise, the cushions 74 and 78, together with flap 76, provide a tight seal between panel 54 and the interior wall of side channel 20. Thus a complete seal is provided between each louver blade 26 and the interior wall of each side panel 20 when the louver assembly is closed, and against passage of air past the jamb seal panels.

The embodiments of the invention in which an exclusive property or privilege is claimed are defined as follows:

1. In a louver assembly having a frame including a first top end frame member, a second bottom end frame member and two opposed mutually parallel side frame members, a plurality of spaced apart, substantially parallel louver blades extending between said side frame members, louver blade pivot shafts integral with said blades along the longitudinal axes of each and extending outwardly from said blades, the louver blades and pivot shafts being pivotally mounted with respect to said side frame members for rotation about their longitudinal axes between open positions and a closed position wherein said blades are in sealing relation to each other and to said first and second end frame members, each louver blade having two transverse blade ends, one such blade end spaced from and facing each side frame member, and means for pivoting said blades between said open and closed positions; wherein said louver assembly includes a jamb seal for sealing the space between each side frame member and its associated louver blade ends, said jamb seal including:

an elongated, rigid panel having a substantially flat face portion in facing, sealing, contacting relation to said louver blade ends at a first end of said blades when said blades are in said closed position, and a plurality of elongated, parallel, spaced apart, rigid ribs integral with and extending outwardly from said face portion in direction away from said louver blade ends to lie in supported relation to a first of said side frame members;

said rigid ribs being provided with resilient cushioning and sealing means positioned between said rigid ribs and said side frame members;

wherein said panel is provided with transverse slots positioned to receive said louver blade pivot shafts when said panel is assembled with the balance of said louver assembly between said side frame and said louver blade ends;

wherein at least one of said ribs is in continuous sealing relationship with respect to said side frame member from said first top frame member to said second bottom frame member and such sealing relationship is not interrupted by said transverse slots; and means for sealing second ends of each of said louver blades with respect to a second of said side frame members.

2. In a louver assembly having a frame including a first top end frame member, a second bottom end frame member and two opposed mutually parallel side frame members, a plurality of spaced apart, substantially parallel louver blades extending between said side frame members, louver blade pivot shafts integral with said blades along the longitudinal axes of each and extending outwardly from said blades, the louver blades and pivot shafts being pivotally mounted with respect to said side frame members for rotation about their longitudinal axes between open positions and a closed position wherein said blades are in sealing relation to each other and to said first and second end frame members, each louver blade having two transverse blade ends, one such blade end spaced from and facing each side frame member, and means for pivoting said blades between said open and closed positions; wherein said louver assembly includes a jamb seal for sealing the space between each side frame member and its assoicated louver blade ends, said jamb seal including:

an elongated, rigid panel having a substantially flat face portion in facing, sealing, contacting relation to said louver blade ends at a first end of said blades when said blades are in said closed position, and a plurality of elongated, parallel, spaced apart, rigid ribs integral with and extending outwardly from said face portion in direction away from said louver blade ends to lie in supported relation to a first of said side frame members;

said ribs including at least a pair of parallel spaced apart outer ribs each integrally connected to said face portion at an outer longitudinal edge of said face portion, and two inner ribs, parallel to and spaced from each other and from said outer ribs and located between said outer ribs;

said rigid ribs being provided with resilient cushioning and sealing means positioned between said rigid ribs and said side frame member, said cushioning and sealing means consisting of elongated cushions in sealing relationship with outer edges of said rigid ribs throughout the length of said panel wherein the rigid panel is also flexible and;

wherein said face portion of said rigid, flexible panel is slightly convexly bowed in cross section in its unstressed, unassembled state and is forced to a substantially flat condition when said jamb seal is positioned to form part of said louver assembly, said flat face portion being at least wide enough to positively seal the entire first end of each louver blade when said blades are in closed position; and means for sealing second ends of each of said louver blades with respect to a second of said side frame members.

3. The jamb seal according to claim 2 wherein said panel is provided with transverse slots positioned to receive said louver blade pivot shafts when said panel is assembled with the balance of said louver assembly between said side frame and said louver blade ends; and wherein at least one of said ribs is in continuous sealing relationship with respect to said side frame member from said first top frame member to said second bottom frame member and such sealing relationship is not interrupted by said transverse slots.

4. In a louver assembly having a frame including a first top end frame member, a second bottom end frame member and two opposed mutually parallel side frame members, a plurality of spaced apart, substantially parallel louver blades extending between said side frame members, louver blade pivot shafts integral with said blades along the longitudinal axes of each and extending outwardly from said blades, the louver blades and pivot shafts being pivotally mounted with respect to said side frame members for rotation about their longitudinal axes between open positions and a closed position wherein said blades are in sealing relation to each other and to said first and second end frame members, each louver blade having two transverse blade ends, one such blade end spaced from and facing each side frame member, and means for pivoting said blades between said open and closed positions; wherein said louver assembly includes a jamb seal for sealing the space between each side frame member and its associated louver blade ends, said jamb seal including:

an elongated, rigid panel having a substantially flat face portion in facing, sealing, contacting relation to said louver blade ends at a first end of said blades when said blades are in said closed position, and a plurality of elongated, parallel, spaced apart, rigid ribs integral with and extending outwardly from said face portion in direction away from said louver blade ends to lie in supported relation to a first of said side frame members;

said plurality of ribs including at least a pair of parallel spaced apart outer ribs each integrally connected to said face portion at an outer longitudinal edge of said face portion;

said rigid ribs being provided with resilient cushioning and sealing means positioned between said rigid ribs and said side frame members, said cushioning and sealing means consisting of elongated cushions in sealing relationship with outer edges of said rigid ribs throughout the length of said panel;

wherein said cushions on said outer ribs each include a relatively thin flexible air seal flipper positioned to lie in intimate sealing relation to a portion of said side frame member spaced away from said panel along the entire length of said cushion; and means for sealing second ends of each of said louver blades with respect to a second of said side frame members.

5. The jamb seal of claim 4 wherein said plurality of ribs also includes two inner ribs, parallel to and spaced from each other and from said outer ribs and located between said outer ribs.

6. The jamb seal of claim 5 wherein the rigid panel is also flexible and wherein said face portion of said panel is slightly convexly bowed in cross section in its unstressed, unassembled state and is forced to a substantially flat condition when said jamb seal is positioned to form part of said louver assembly, said flat face portion being at least wide enough to positively seal the entire first end of each louver blade when said blades are in the closed position.

7. The jamb seal of claim 6 wherein said means for sealing said second ends of said blades includes a second jamb seal as defined in claim 6.

8. The jamb seal of claim 6 wherein said face portion of said panel is made from a material substantially exhibiting the physical properties of rigid vinyl.

9. The jamb seal of claim 8 wherein said cushions are made from a material substantially exhibiting the physical properties of soft vinyl.

10. The jamb seal according to claim 6 wherein said panel is provided with transverse slots positioned to receive said louver blade pivot shafts when said panel is assembled with the balance of said louver assembly between said side frame and said louver blade ends; and wherein at least one of said ribs is in continuous sealing relationship with respect to said side frame member from said first top frame member to said second bottom frame member and such sealing relationship is not interrupted by said transverse slots.

11. The jamb seal of claim 10 wherein said means for sealing said second ends of said blades includes a second jamb seal as defined in claim 10.

12. The jamb seal of claim 11 wherein said face portions of said panels are made from a material substantially exhibiting the physical properties of rigid vinyl.

13. The jamb seal of claim 12 wherein said cushions are made of a material substantially exhibiting the physical properties of soft vinyl.

* * * * *